US007477863B2

(12) United States Patent
Watanabe et al.

(10) Patent No.: US 7,477,863 B2
(45) Date of Patent: Jan. 13, 2009

(54) IMAGE FORMING APPARATUS AND IMAGE FORMING METHOD WITH CLEANER PORTION

(75) Inventors: Takeshi Watanabe, Ichikawa (JP); Masashi Takahashi, Yokohama (JP); Minoru Yoshida, Machida (JP); Shoko Shimmura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/701,435

(22) Filed: Feb. 2, 2007

(65) Prior Publication Data

US 2007/0134016 A1 Jun. 14, 2007

Related U.S. Application Data

(63) Continuation of application No. 10/971,032, filed on Oct. 25, 2004, now abandoned.

(51) Int. Cl.
*G03G 21/00* (2006.01)

(52) U.S. Cl. ..... 399/101; 399/66; 399/300; 399/303; 399/306; 399/359

(58) Field of Classification Search ..... 399/71, 399/149, 150, 299, 302, 306, 308
See application file for complete search history.

(56) References Cited

U.S. PATENT DOCUMENTS

| | | | | |
|---|---|---|---|---|
| 4,588,285 | A | 5/1986 | Tagoku | |
| 5,740,493 | A | 4/1998 | Otaki et al. | |
| 6,185,387 | B1 | 2/2001 | Ohzeki et al. | |
| 6,201,939 | B1 * | 3/2001 | Yamamoto et al. | 399/227 |
| 6,799,010 | B2 | 9/2004 | Namiki | |
| 2003/0142988 | A1 | 7/2003 | Kimura | |
| 2004/0228656 | A1 | 11/2004 | Kamimura | |

FOREIGN PATENT DOCUMENTS

| | | | |
|---|---|---|---|
| JP | 2001188393 A | * | 7/2001 |
| JP | 2003-295542 A | | 10/2003 |

* cited by examiner

*Primary Examiner*—David M Gray
*Assistant Examiner*—Ryan D Walsh
(74) *Attorney, Agent, or Firm*—Foley & Lardner LLP

(57) ABSTRACT

A color image forming apparatus includes an intermediate transfer member, a first forming portion having a first transfer unit, a second forming portion provided downstream from the first forming portion, a third forming portion provided downstream from the second forming portion, a fourth forming portion provided downstream from the third forming portion, and a control portion. The control portion controls a bias of at least one of the corresponding developing unit and the corresponding transfer unit, when transfer of the toner image from the intermediate transfer member to the recording medium is completed, so that a toner-image residue toner material resting on the intermediate transfer member is returned to the corresponding developing unit through the image bearing member of at least one of the first to fourth forming portions.

18 Claims, 12 Drawing Sheets

FIG. 13

Fogging status ○ : OK、× : NG

| Transfer method | Remarks | Developing unit | Automatic developer ejection amount | Developer storage capacity | After 50k pieces | After 100k pieces | After 200k pieces | After 300k pieces |
|---|---|---|---|---|---|---|---|---|
| Inter-mediate transfer | Configuration returning secondary-transfer residue toner, etc. to black-color developing unit | Color | 0 | 200g | ○ | ○ | × | |
| | | Black | 0 | 200g | × | | | |
| | | | 0 | 400g | ○ | ○ | × | |
| | | Color | 2g/k-piece | 200g | ○ | ○ | ○ | ○ |
| | | Black | 2g/k-piece | 200g | ○ | × | × | × |
| | | | 2.5g/k-piece | 200g | ○ | ○ | × | × |
| | | | 2g/k-piece | 400g | ○ | ○ | ○ | × |
| | | | 2.5g/k-piece | 400g | ○ | ○ | ○ | ○ |
| | Configuration, particularly, as shown in FIG. 9, in addition to above | First stage (Y) | 2g/k-piece | 200g | ○ | ○ | ○ | × |
| | | First stage (Y) | 2.5g/k-piece | 200g | ○ | ○ | ○ | ○ |
| | | First stage (Y) | 2g/k-piece | 400g | ○ | ○ | ○ | ○ |
| | | Second, third stage (M, C) | 2g/k-piece | 200g | ○ | ○ | ○ | ○ |
| Direct transfer | State where belt cleaner is inoperative at printing operation | First stage (Y) | 2g/k-piece | 200g | ○ | ○ | ○ | × |
| | | First stage (Y) | 2.5g/k-piece | 200g | ○ | ○ | ○ | ○ |
| | | First stage (Y) | 2g/k-piece | 400g | ○ | ○ | ○ | ○ |
| | | Second, third stage (M, C) | 2g/k-piece | 200g | ○ | ○ | ○ | ○ |
| | | Fourth stage (black) | 2g/k-piece | 200g | ○ | ○ | ○ | × |
| | | | 2g/k-piece | 400g | ○ | ○ | ○ | ○ |
| | | | 2.5g/k-piece | 200g | ○ | ○ | ○ | ○ |

IMAGE FORMING APPARATUS AND IMAGE FORMING METHOD WITH CLEANER PORTION

The present application is a Continuation of U.S. application Ser. No. 10/971,032, filed Oct. 25, 2004, the entire contents of which is incorporated herein by reference.

BACKGROUND OF THE INVENTION

The present invention relates to an image forming apparatus, such as an electrophotographic copier, facsimile machine, or printer, or combinations thereof.

In recent years, along with performance enhancement of image forming apparatuses such as digital copiers, comprehensive digital devices having not only a copying function, but also a printer function have been developed and widely used.

In such a digital copier or the like, cleaners are used in a method for collecting residue toner material occurring on a photoreceptor surface. A cleanerless process is known as being advantageous to implement, for example, apparatus miniaturization and toner saving. Nevertheless, however, although no cleaners are provided in the photoreceptor, cleaners for cleaning a transfer belt, an intermediate transfer member, and a like are necessary in a color digital copier, printer, or the like having a tandem configuration. In this connection, a toner collection method has been disclosed. According to the method, toner deposited on media such as a transfer belt and an intermediate transfer member is not cleaned by a dedicated cleaner therefor, but residue toner material is tentatively returned to the side of photoreceptors, whereby to collect the residue toner.

For example, Jpn. Pat. Appln. KOKAI Publication No. 2003-295542 discloses toner collection methods by way of examples. In one example method, patterns of individual colors intentionally printed on a transfer belt to perform image quality control are serially selectively returned to photoreceptors of corresponding colors and are then collected by developing units of the individual colors. In another example, when an image is inadvertently printed on the belt because of, for example, a paper jam, while in the case of a monochrome pattern, the pattern is returned to a photoreceptor in a station of the corresponding color, whereas in the case of mixed color patterns of two or more colors, the patterns are collectively returned to a photoreceptor in a black-color station, and the patterns are then collected by the black-color developing unit in which the mixed color is inconspicuous. According to the above-described conventional techniques, the amount of toner to be collected and reused in, for example, a direct transfer method, so that even when a paper jam has occurred, the amount of other-color toner being entrained into the black-color developing unit is small.

However, when the method for collecting toner material into the developing unit is used in an image forming apparatus using an intermediate transfer method, a problem is generated in which a large amount of other-color toner as being a secondary-transfer residue toner is entrained into the black-color developing unit, thereby changing the color property of black.

BRIEF SUMMARY OF THE INVENTION

A color image forming apparatus which is an embodiment of the present invention comprises: an intermediate transfer member which carries a toner image to be transferred to a recording medium; a first forming portion having a first charger unit which charges a first image bearing member bearing a first-color (black color) toner image configuring a color image; a first exposure unit which forms a first electrostatic latent image on the first image bearing member in accordance with given image information; a first developing unit which forms the first-color toner image corresponding to the first electrostatic latent image on the first image bearing member; and a first transfer unit which transfers to the intermediate transfer member the first-color toner image formed by the first developing unit; a second forming portion provided downstream from the first forming portion, the second forming portion having a second charger unit which charges a second image bearing member bearing a second-color toner image configuring the color image; a second exposure unit which forms a second electrostatic latent image on the second image bearing member; a second developing unit which forms the second-color toner image corresponding to the second electrostatic latent image on the second image bearing member; and a second transfer unit which transfers to the intermediate transfer member the second-color toner image formed by the second developing unit; a third forming portion provided downstream from the second forming portion, the third forming portion having a third charger unit which charges a third image bearing member bearing a third-color toner image configuring the color image; a third exposure unit which forms a third electrostatic latent image on the third image bearing member; a third developing unit which forms the third-color toner image corresponding to the third electrostatic latent image on the third image bearing member; and a third transfer unit which transfers to the intermediate transfer member the third-color toner image formed by the third developing unit; a fourth forming portion provided downstream from the third forming portion, the fourth forming portion having a fourth charger unit which charges a fourth image bearing member bearing a fourth-color toner image configuring the color image; a fourth exposure unit which forms a fourth electrostatic latent image on the fourth image bearing member; a fourth developing unit which forms the fourth-color toner image corresponding to the fourth electrostatic latent image on the fourth image bearing member; and a fourth transfer unit which transfers to the intermediate transfer member the fourth-color toner image formed by the fourth developing unit; and a control portion which, when transfer of the toner image from the intermediate transfer member to the recording medium is completed, controls a bias of at least one of the corresponding developing unit and the corresponding transfer unit so that a toner-image residue toner material resting on the intermediate transfer member is returned to the corresponding developing unit through the image bearing member of at least one of the first to fourth forming portions.

BRIEF DESCRIPTION OF THE SEVERAL VIEWS OF THE DRAWING

FIG. 13 is a table showing example items relative to running costs of an image forming apparatus according to one embodiment of the present invention.

DETAILED DESCRIPTION OF THE INVENTION

With reference to the drawings, a toner collection process with transfer-bias switching of an image forming apparatus according to one embodiment of the present invention will be described in detail below.

<Image Forming Apparatus According to One Embodiment of the Invention>

(Mechanical Configuration of Image Forming Apparatus According to One Embodiment of the Invention)

Figure 1:
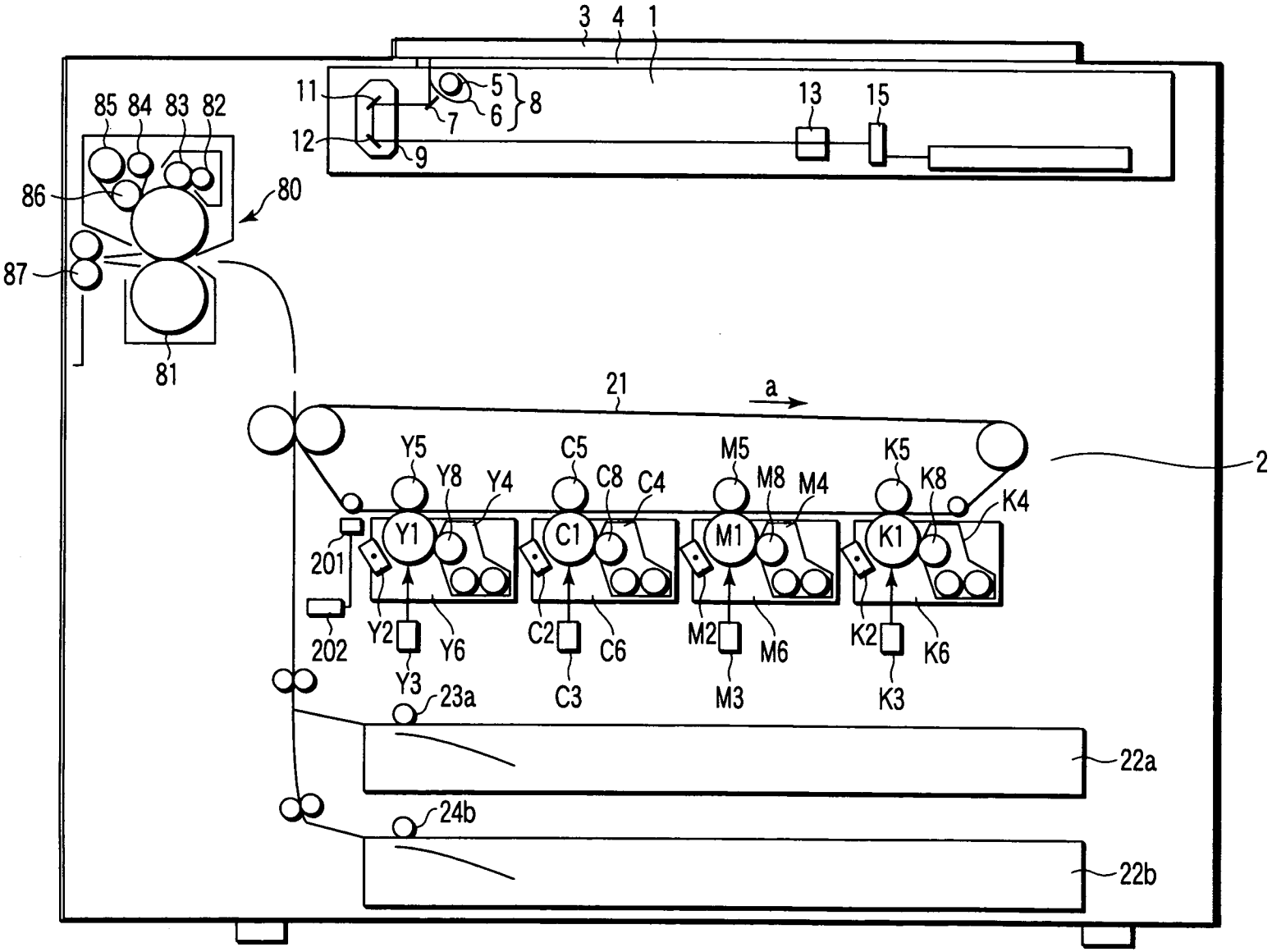
FIG. 1 is a cross-sectional view showing an example of a mechanical configuration of an image forming apparatus according to one embodiment of the present invention.
Figure 2:
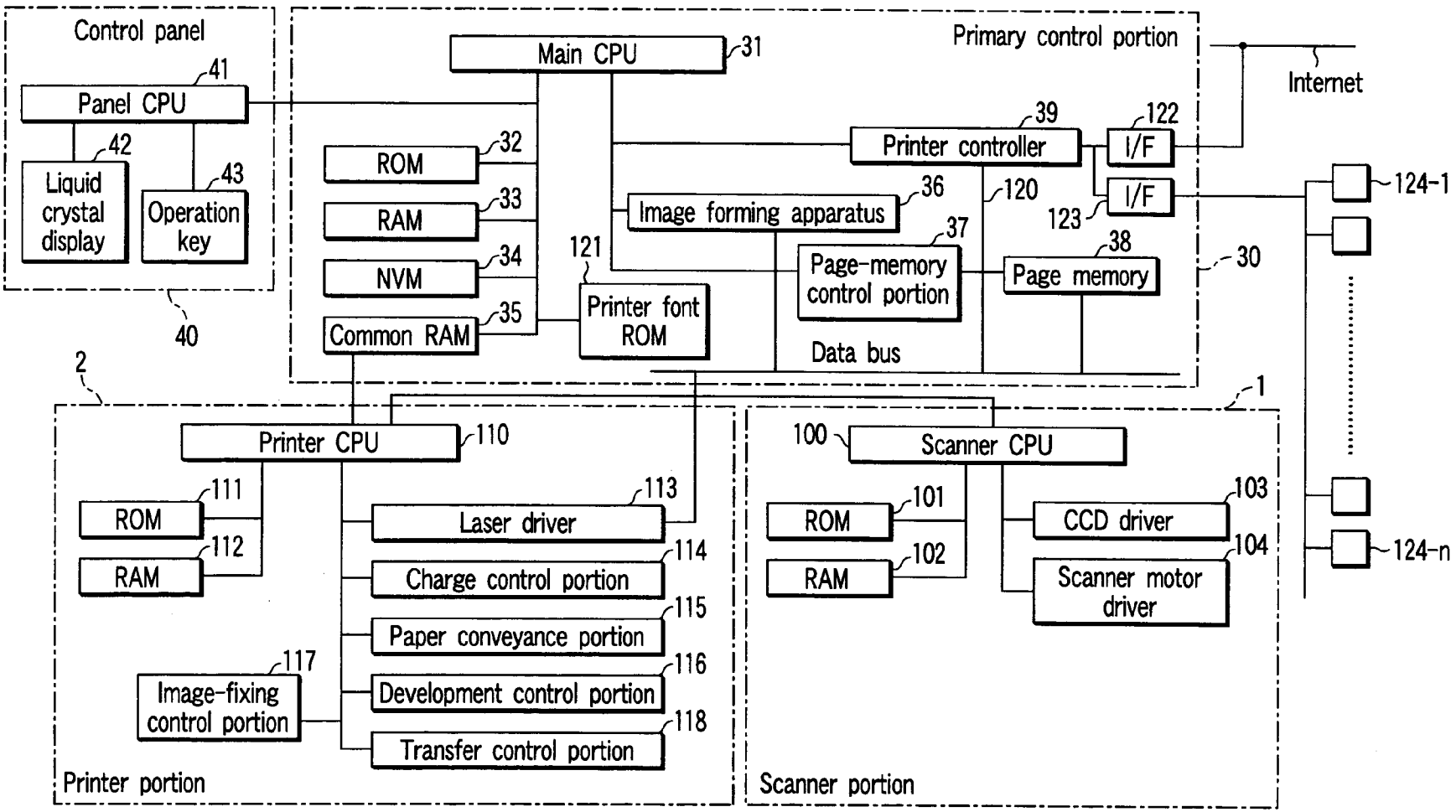
FIG. 2 is a block diagram showing an example of an electrical configuration of the image forming apparatus according to one embodiment of the present invention.
Figure 3:
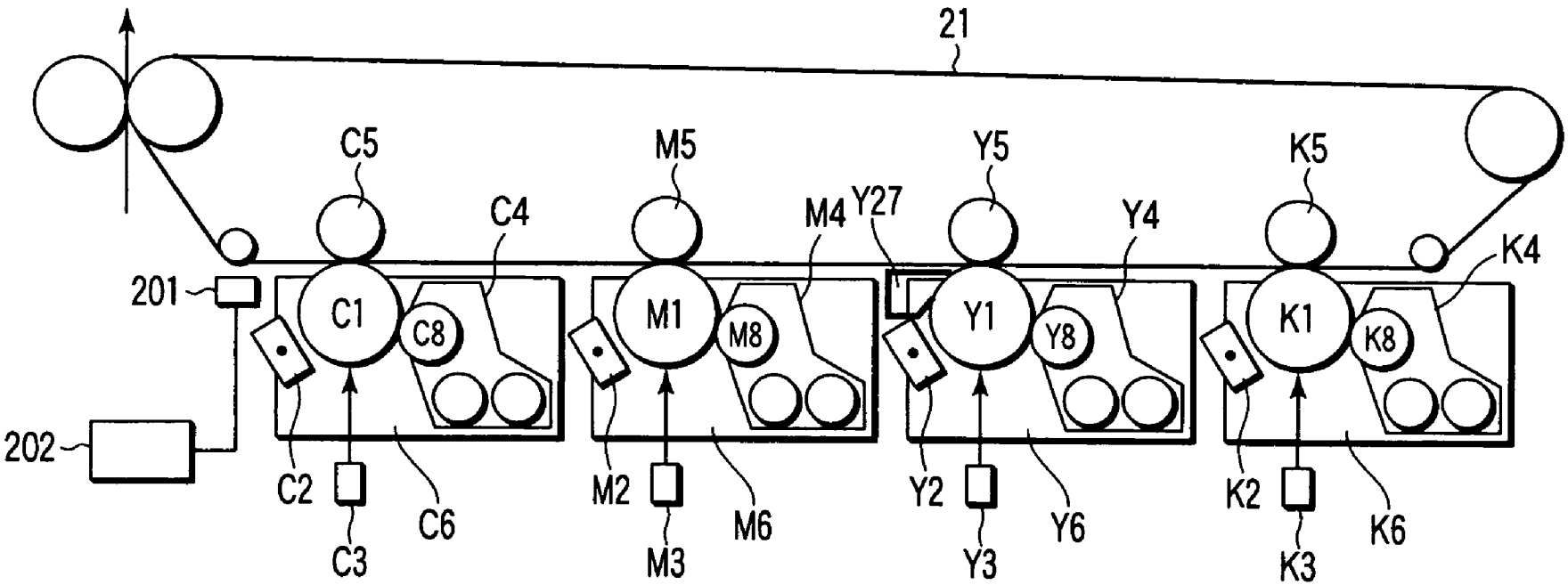
FIG. 3 is a cross-sectional view showing an example of an image forming unit of the image forming apparatus according to one embodiment of the present invention.

Firstly, the following will describe an example of the configuration of a complex image forming apparatus according to one embodiment of the present invention. FIG. 1 is a cross-sectional view showing an example of a mechanical configuration of the image forming apparatus according to one embodiment of the present invention. FIG. 2 is a block diagram showing an example of an electrical configuration of the image forming apparatus according to one embodiment of the present invention. FIG. 3 is a cross-sectional view showing an example of an image forming unit of the image forming apparatus according to one embodiment of the present invention. Referring to these drawings, a digital color copier is configured of a scanner portion 1, which works as being a read function, and a printer portion 2, which works as being an image forming function.

The scanner portion 1, which reads images of an original document, has a document-stack cover 3 in an upper portion; and a document stack 4 that is formed of transparent glass on which a document D and that is disposed to oppose the document-stack cover 3 being in a closed state. Various components are disposed below the document stack 4, including an exposure lamp 5 for illuminating the document D stacked on the document stack 4; a reflector 6 for performing focusing light from the exposure lamp 5 to the document D; and a first mirror 7 for deflecting light reflected off of the document D in a left direction as viewed in the drawing. The exposure lamp 5, the reflector 6, and the first mirror 7 are secured to a first carriage 8. The first carriage 8 is connected to a pulse motor (not shown) via, for example, a toothed belt (not shown), wherein a driving force of the pulse motor is transmitted thereby to move the first carriage 8 parallel with the document stack 4.

An imaging lens 13 is disposed in a plane including an optical axis of the light deflected through a second carriage 9. The imaging lens 13 images light reflected off the second carriage 9 at a predetermined magnification ratio. A CCD (charge-coupled device) image sensor 15 (photoelectric conversion unit) is disposed in a plane substantially perpendicular to the optical axis of light passed through the imaging lens 13. The CCD image sensor 15 converts the reflected light, to which focusability has been imparted by the imaging lens 13, to an electric signal, that is, image data.

The printer portion 2 has first to fourth image forming portions K6, M6, C6, and Y6 for forming respective images color-separated in units of a color component in accordance with the well-known subtractive color mixture process, that is, images of four colors. The four colors are black (represented by "k" or "K", hereafter), magenta (a type of red; represented by "m" or "M", hereafter), cyan (bluish purple; represented by "c" or "C", hereafter), and yellow (represented by "y" or "Y").

An intermediate transfer belt 21 is disposed below the individual image forming portions K6, M6, C6, and Y6, wherein the intermediate transfer belt 21 carries, in an a-arrow direction in the drawing, respective-color images formed by the respective image forming portions. The intermediate transfer belt 21 runs continuously or endlessly at a predetermined constant velocity along the a-arrow direction. The image forming portions K6, M6, C6, and Y6 are arranged in series along the conveyance direction of the intermediate transfer belt 21.

The respective image forming portions K6, M6, C6, and Y6 include photosensitive drums K1, M1, C1, and Y1 individually working as image bearing media formed rotatable in the same direction at positions where individual outer circumferential surfaces thereof are in contact with the intermediate transfer belt 21. The photosensitive drums are individually provided in connection with drum motor (not shown) thereby to be rotated at a predetermined peripheral velocity.

Individual axis lines of the photosensitive drums K1, M1, C1, and Y1 are deployed perpendicular to the direction along which images are conveyed by the intermediate transfer belt 21. Concurrently, the axis lines are deployed at identical spaces being away from one another. Descriptions below will be made with reference to a case assumed such that the direction of the individual axis lines be a primary scan direction (second direction). Concurrently, the direction along which the photosensitive drums are rotated, that is, the rotational direction of the printer portion 2 (a-arrow direction in the drawing) is assumed as being a secondary scan direction (first direction).

Around the respective photosensitive drums K1, M1, C1, and Y1, the following members are serially provided extending along the rotational direction of the corresponding photosensitive drums. They are electric charger units K2, M2, C2, and Y2 as being charging means provided extending along the primary scan direction; developing rollers K8, M8, C8, and Y8 as being developing means provided also extending along the primary scan direction; and transferring rollers K5, M5, C5, and Y5 as being transferring means provided also along the primary scan direction.

Individual primary transfer units are disposed in positions where the intermediate transfer belt 21 are pinched between themselves and the corresponding photosensitive drums, that is, inside of the closed loop of the intermediate transfer belt 21. As such, individual points of exposure by exposure units described below are formed on outer circumferential surfaces of the photosensitive drums between the charger units and the developing rollers.

Secondary transferring rollers are located in contact with the intermediate transfer belt 21. When a recording medium is fed between the intermediate transfer belt 21 and the secondary transferring rollers, an image is transferred to the medium or recording paper from the intermediate transfer members.

A positional-mismatch sensor 201 for sensing the position of an image formed over the intermediate transfer belt 21 is disposed on one end side of the closed loop of the intermediate transfer belt 21. The positional-mismatch sensor 201 is formed of a transmissive or reflective optical sensor, and is connected to a control portion 202 comprising of, for example, a CPU 110 (central processing unit), a ROM 111 (read-only memory), and a RAM 112 (random access memory), described in detail with reference to FIG. 2.

Respective exposure units K3, M3, C3, and Y3 for forming color-separated electrostatic latent images are provided on the photosensitive drums to radiate laser beams corresponding to respective colors toward exposure positions of the corresponding photosensitive drums.

(Electrical Configuration of Image Forming Apparatus According to One Embodiment of the Invention)

FIG. 2 is a block diagram schematically showing electrical connection and flow of control signals of the digital color copier shown in FIG. 1. With reference to the drawing, the digital color copier is configured three CPUs: a main CPU 31 of a primary control portion 30; a scanner CPU 100 of the scanner portion 1; and a printer CPU 110 of the printer portion 2. The main CPU 31 performs bi-directional communication with the printer CPU 110 through a common RAM 35. The main CPU 31 issues an operation instruction, and the printer CPU 110 returns thereto the current status of its own thereto. The printer CPU 110 and the scanner CPU 100 perform serial communication. The printer CPU 110 issues an operation instruction, and the scanner portion 100 returns thereto the current status of its own.

A control panel 40 is coupled to the main CPU 31, and is configured of a panel CPU 41, an LCD 42 (liquid crystal display), and print keys 43. A display representing a tree state of a network and a plurality of units are presented in accordance with processes of the panel CPU 41 and the main CPU 31, described below.

The primary control portion 30 is configured of the main CPU 31, a ROM 32, a RAM 33, an NVM 34 (nonvolatile memory), the common RAM 35, an image processor apparatus 36, a page-memory control portion 37, a page memory 38, a printer controller 39, and a printer font ROM 121.

The main CPU 31 is responsible for controlling the entirety of the primary control portion 30. The ROM 32 contains control programs. The RAM 33 is used to temporarily store data.

The common RAM 35 is used for the bi-directional communication between the main CPU 31 and the printer CPU 110.

The page-memory control portion 37 performs operations, such as storing data into the page memory 38 and reads of data therefrom. The page memory 38 has an area capable of storing multipage image data, and is formed capable of storing in units of one page of compressed image data received from the scanner portion 1.

In the printer font ROM 121, font data corresponding to print data is pre-stored.

The printer controller 39 expands print data into image data by using font data being stored in the printer font ROM 121 at resolutions corresponding to resolution data given to the print data. The print data are received from external units 124-1 to **124-*n*** in a network of personal computers and the like units.

An interface 122 ("I/F") constituting a communication portion section is used in connection to the Internet through an Ethernet, for example. Similarly, an interface 123 constituting a communication portion for communication with the plurality of devices 124-1 to **124-*n* in the network in compliance with a communication protocol such as an Ethernet. The communication protocol need not be necessarily an Ethernet, but may be a protocol compliant with, for example, the IEEE (Institute of Electrical and Electrical Engineers) 1394** or USB (universal serial bus). Alternatively, a case is preferable a plurality of interfaces are provided to implement synchronous parallelism of networks compliant to the IEEE 1394 and USB, or other communication protocols.

The scanner portion 1 is configured of the scanner CPU 100 for controlling the entirety of the scanner portion 1; a ROM 101 containing control programs and the like; a RAM 102 for storing data; a CCD driver 103; and a scan motor driver 104 for controlling revolution of motors for moving, for example, the exposure lamp 5 and the mirrors 7, 11, and 12.

The printer portion 2 is configured of the printer CPU 110 for controlling the entirety of the printer portion 2; a ROM 111 containing control programs and the like; a RAM 112 for storing data; a laser driver 113 for turning on/off the emission of the exposure units K3, M3, C3, and Y3; a paper conveyance portion for controlling the conveyance of paper P that is performed by a conveyance mechanism; a charge control portion 114 for controlling biases to the charger units K2, M2, C2, and Y2; a development control portion 116 for controlling biases to the developing rollers K8, M8, C8, and Y8; a transfer control portion 118 for controlling biases to the transferring rollers K5, M5, C5, and Y5; and an image-fixing control portion 117 for controlling an image-fixing member 80.

The image processor apparatus 36, the page memory 38, the printer controller 39, and the laser driver 113 are interconnected via an image data bus 120.

The complex image forming apparatus having the configuration described above performs image forming of an original image, which has been taken in through the scanner portion 1, on paper being fed as a recording medium by using the printer portion 2 in accordance with various given specifications. However, the complex image forming apparatus is capable of performing not only the above-described operation, but various other operations. For example, the apparatus is capable of performing facsimile communication and electronic mail (e-mail) communication through the interfaces 122 and 123 constituting the communication portion. In addition, as described below, the apparatus is able to perform, for example, the operation of acquiring image information from a device in the network and printing the information, and the operation of transmitting image information read out by the scanner to a specified device in the network.

(Toner Collection Method for Image Forming Apparatus According to One Embodiment of the Invention)

A toner collection method for the image forming apparatus according to one embodiment of the present invention will be described in detail below with reference to the drawings.

(Cleanerless Process)

To begin with, a cleanerless process of the image forming apparatus according to one embodiment of the present invention will be described here. As is shown in FIG. 1, the image forming apparatus according to one embodiment of the present invention is of a tandem type in regard to the intermediate transfer, wherein the plurality of image forming portions K6, M6, C6, and Y6 are disposed along intermediate transfer members, such as the belt. In the image forming portion K6 on the first stage, the photosensitive drum K1 is formed such that an organic or amorphous silicon photoreceptive layer is provided on a conductive base body. By way of example, the present embodiment will be described with reference to the case of an organic photoreceptor allowing charge on a negative polarity. The image bearing member K1 (photosensitive drum) is uniformly charged to, for example, −500V by a well-known roller charger unit, corona charger unit, and scorotron charger unit K2, and is then exposed by the exposure unit K3 with, for example, an image-modulated laser beam or LED, whereby an electrostatic latent image is formed on the surface. In this case, the potential of the exposed photoreceptor surface becomes about −80V. Thereafter, image visualization or visualized-image forming of the electrostatic latent image is performed by the exposure unit K4. In this case, the exposure unit K4 operates as follows. A starter spot (like ears of rice) of a carrier is formed on the developing roller having a magnet in accordance with a two-component developing technique using a mixture of a negatively chargeable nonmagnetic toner and magnetic carrier. Then, a bias ranging from about −200v to about −400v is applied to the developing roller K8. Thereby, the toner is adhered in an exposure region of the surface of the photosensitive drum K1, but the toner is not adhered to non-exposure-unit units.

In addition, the visualized image on the photosensitive drum is transferred to the intermediate transfer belt 21 brought into contact with the photosensitive drum K1. In this case, electric-field supply is performed by the transferring member K5, such as the transferring roller, which has been brought into contact with the back surface of the intermediate transfer belt 21. In this case, the voltage applied to the transferring member is ranged from about 300v to 2 kv. Residue toner or the like remaining on the photosensitive drum K1 after transfer (transfer residue toner) is passed a disturbing member (not shown) provided to erase memory of a transfer residue image, when necessary. Further, the photosensitive drum K1 is appropriately static-eliminated or deelectrified, and the above-described charging steps are repeated. In this case, having been passed through the charging steps, the transfer residue toner and the photosensitive drum surface are charged to the same polarity (negative polarity in the present embodiment) as the charge potential of the photosensitive drum K1. Thereafter, when the surface of the photosensitive drum on which the electrostatic latent image has been formed by the exposure unit K3 reaches the exposure unit K4, the image region (the above-described electrostatic latent image) is developed by the developing roller K8. At the same time, residue toner on a non-image region is collected in the side of the developing roller K8, whereby so-called "simultaneous cleaning and developing" can be implemented. Thereby, an electrophotographic process of the image forming portion K6 on the first stage is continuously performed without a cleaner such as a blade being provided on the photoreceptor.

Subsequently, among the remaining image forming portions M6, C6, and Y6 on the second and other stages, the image forming portion M6 on the second stage will be described hereinbelow. All the relative members such as the photosensitive drum M1, the charger unit M3, the developing unit M4, and the transferring unit M5 have similar configurations as those on the first stage. However, an image formed in the previous-stage image forming portion K6 and transferred to the intermediate transfer member enters between the second-stage transferring roller M5 and the photosensitive drum M1. As such, depending on the condition, a phenomenon takes place in that a portion of the image formed in the first-stage image forming portion K6 is transferred back to the second-stage photosensitive drum M1.

In this case, toner transferred to the intermediate transfer member is at a negative polarity, and a bias ranging from about +300v to about +2 kv is applied to the transferring roller M5. As such, theoretically the toner on the first stage does not move from the surface of the intermediate transfer belt 21. However, an excessive discharge phenomenon occurs in the transferring roller M5, part of the toner is reverse-charged to be positive, and adheres to the second-stage photosensitive drum M1 side. The toner in the first-stage image forming portion K6 having thus adhered to the second-stage image bearing member M1 is returned in polarity by the charger unit M2 to negative through processing similar to that in the first stage. The toner is then entrained in the second-stage developing unit M4, whereby a color mixture phenomenon is caused depending on the condition.

Subsequently, there are third-stage and fourth-stage image forming portions M6 and C6, and the configurations thereof are similar to those on the second stage.

(Residue Toner Collection Method)

First Embodiment

A first embodiment provides an image forming apparatus that performs collection of residue toner into a black-color developing unit in accordance with transfer-bias switching in an intermediate transfer method. Specifically, in an image forming apparatus employing an intermediate transfer method, since a toner image is secondary-transferred to a transfer target medium such as paper from the intermediate transfer member such as a belt, transfer residue toner occurs on the belt. According to the present invention, the residue toner is not handled as toner waste, but is collected. More specifically, the residue toner is returned to the black-color photosensitive drum and is then collected by the black-color developing unit. As shown in FIG. 1, the image forming apparatus is characterized in that the black-color image forming portion K6 is provided on the highest upstream side (first stage). Consequently, in the intermediate transfer method, when the black-color developing unit is provided on the highest upstream side, a black image is a lowest layer in a color toner image on the intermediate transfer member. As such, in the case of a color image containing the black color or black image, transfer residue toner occurring on the intermediate transfer member during the secondary transfer from the intermediate transfer member to paper almost becomes black toner. For this reason, even when transfer residue toner on the intermediate transfer member is collected by the black-color developing unit, an other-color entrainment ratio is low, and the problem of mixed color does not easily occur.

Figure 6:
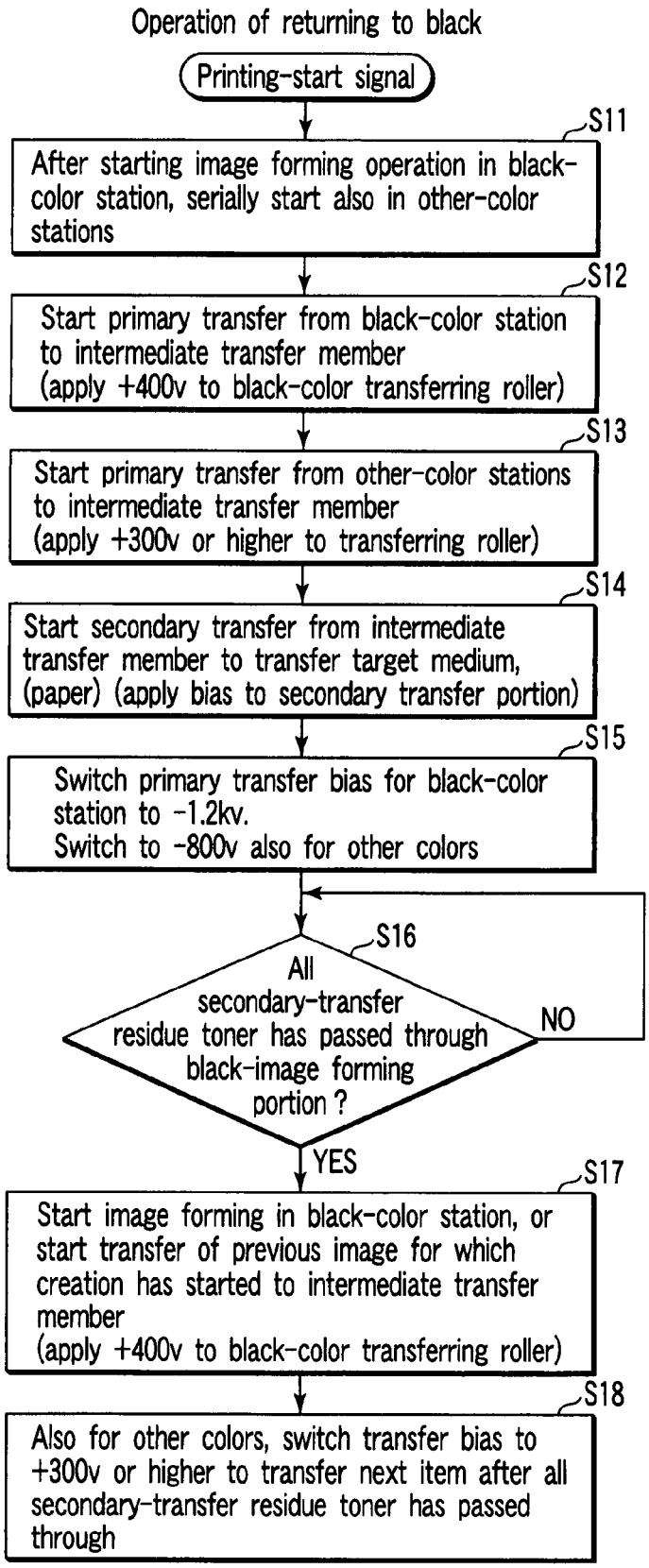
FIG. 6 is a flow diagram in the event that toner materials are returned to a black-color station of an image forming apparatus according to one embodiment of the present invention.

Processing will be described in detail hereinbelow with reference to a flow diagram of FIG. 6. To begin with, the processing initiates an image forming operation in the black-color station, and then serially initiates image forming operations also in other stations (S11 (S stands for step)). Subsequently, the processing initiates primary transfer from the black-color station to the intermediate transfer member 21. By way of an example, a bias of +400v is applied to a black-color transferring roller (S12). Primary transfer is serially initiated for the other colors. By way of an example, a bias of +300v or higher is applied to the transferring rollers (S13). Then, bias is applied to the secondary transferring unit, thereby to initiate the secondary transfer from the intermediate transfer member 21 to a transfer target medium (paper) (S14).

Thereafter, upon termination of the primary transfer of the image in the black-color station, bias for the transferring roller K5 of the black-image forming portion K6 is set to about −1.2 kv. Thereby, of secondary-transfer residue toner, toner with a negative polarity is moved to the black-color photosensitive drum K1, so that toner with a positive polarity remains on the belt. Thereafter, for the color image forming portions M6, C6, and Y6, the transfer bias is switched to, for example, −800v, and the toner is passed the portions by being kept left on the belt (S15). In this case, when the negative bias for transfer is set lower for the black-image forming portion K6, the occurrence of backward transfer is reduced, thereby offering advantage to a mixed color.

After all the secondary-transfer residue toners have passed the black-image forming portion (S16), a bias of +400v, for example, is applied to the transferring roller K5 to start image forming in the black-color station or to start transfer of an image of which creation has been previously started (S17). Thereby, toners are transferred superposed over the positive toner staying on the belt in an image region, whereas the positive toner on the belt is transferred to the photosensitive drum K1, and residue toner is collected in the black-color exposure unit K4 in a non-image region. In addition, since the black-image forming portion is disposed on the highest upstream side, a risk can take place in that, when backward transfer takes place in and after the second-stage image forming portion, black toner is entrained into the color developing unit thereby to change the color. As such, the backward transfer is preferably prevented in the manner that the transfer bias in the second stage is set lower than that for the first-stage black-image forming portion K6. For example, when the bias for the transferring roller K5 of the black-image forming portion K6 is +400v, the bias for the second stage or thereafter is set to +300v, whereby backward transfer can be effectively prevented (S18).

However, with the provision of such a difference in bias value, a case can take place in which the transfer efficiency is reduced in the second-stage image forming portion or thereafter, thereby leading to deterioration of image quality. To prevent such a problem, the arrangement may be such that a dedicated photoreceptor cleaner such as a blade contactable with the photosensitive drum surface is provided in the image forming portion on the second stage or thereafter. Especially, since the yellow-image forming portion is weak against black-color entrainment, there is a choice for provide a cleaner Y27, as shown in FIG. 3. In regular cases, most of toner waste is secondary-transfer residue toner, and primary-transfer residue toner is insignificant in volume. In terms of improving the efficiency of toner consumption, substantially no differences occur in the efficiency even when a photoreceptor cleaner is provided in the yellow-image forming portion. As such, the cleaner is effective means in view of preventing color mixture and concurrently reducing the overall toner waste.

Further, even with the black-image forming portion K6 being provided on the highest upstream side, concern about color mixture can be eliminated by providing cleaners to all the color photosensitive drums Y1, M1, and C1 thereby to prevent the color mixture. In this case, while toner waste occurs from the color image forming portions Y6, M6, and C6, secondary-transfer residue toner can be reused also in this case, so that toner waste can be reduced overall. In this manner, secondary-transfer residue toner, which offers one of most critical problems in the configuration employing the intermediate transfer method, can be effectively collected in the black-color exposure unit K4. Consequently, the apparatus can be made to be of a "toner-waste-less" or "less-toner-waste" type.

Second Embodiment

Figure 4:
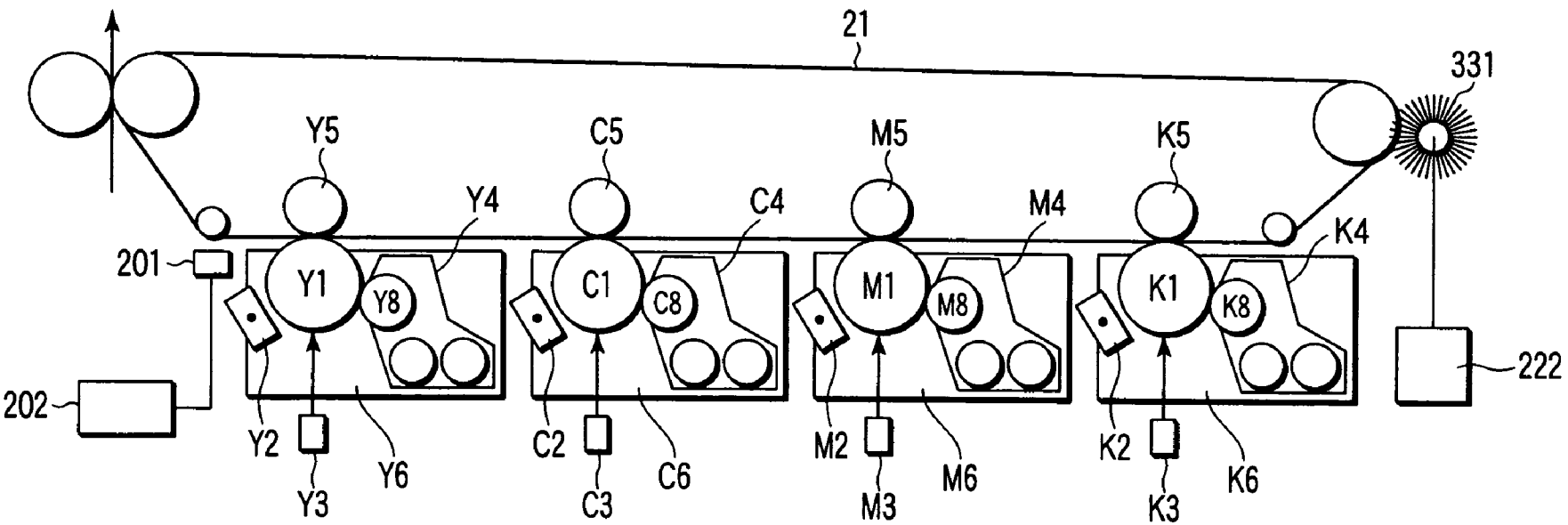
FIG. 4 is a cross-sectional view showing another example of an image forming unit of an image forming apparatus according to one embodiment of the present invention.

A second embodiment provides an image forming apparatus that concurrently uses a toner retaining member (toner-polarity reversing portion), such as a brush roller, when collecting residue toner by transfer-bias switching. Specifically, according to the first embodiment or the like, a problem occurs in that, during reversal of the transfer bias, regular image forming operation cannot be performed, so that the printing speed is reduced to about a ½ level, in comparison to conventional cases. As such, in the second embodiment, as shown in FIG. 4, a toner retaining member 331, such as a brush roller, is mounted between the intermediate transfer member 21 and the black-image forming portion K6. Secondary-transfer residue toner is temporarily retained by the toner retaining member 331, ejected to the intermediate transfer member 21 in execution of a separately provided ejection operation, moved to the black-color photosensitive drum K1 through the black-color transferring roller K5, and then collected in the black-color exposure unit K4.

As an example configuration using the toner retaining member 331, a nylon brush roller having a 16 mm diameter is rotated at 1:1 ratio with respect to peripheral velocity of the belt in the direction of the belt rotation, and a bias of +700v is applied thereto by a charger portion 222. Thereby, of transfer residue toner, toner with a negative polarity is collected in the side of the toner retaining member 331. In the toner retaining member 331 (brush), toner is stored, and the polarity of toner is progressively reversed to a positive polarity, and toner with the positive polarity is progressively released onto the intermediate transfer member 21. The toner with the positive polarity is not attracted to the toner retaining member 331, is further irradiated with positive electric discharge of the toner retaining member 331, and is passed therethrough. The transfer residue toner changed in polarity to positive receives a bias of, for example, +400v from the transferring roller K5. The toner is thereby moved to the photosensitive drum side in a non-image region, and is superposed with black toner in an image region whereby to form an image in the next step.

Unless the bias for the toner retaining member 331 is periodically switched to eject and toner having been retained, the performance of the toner retaining member 331 cannot be maintained.

Figure 7:
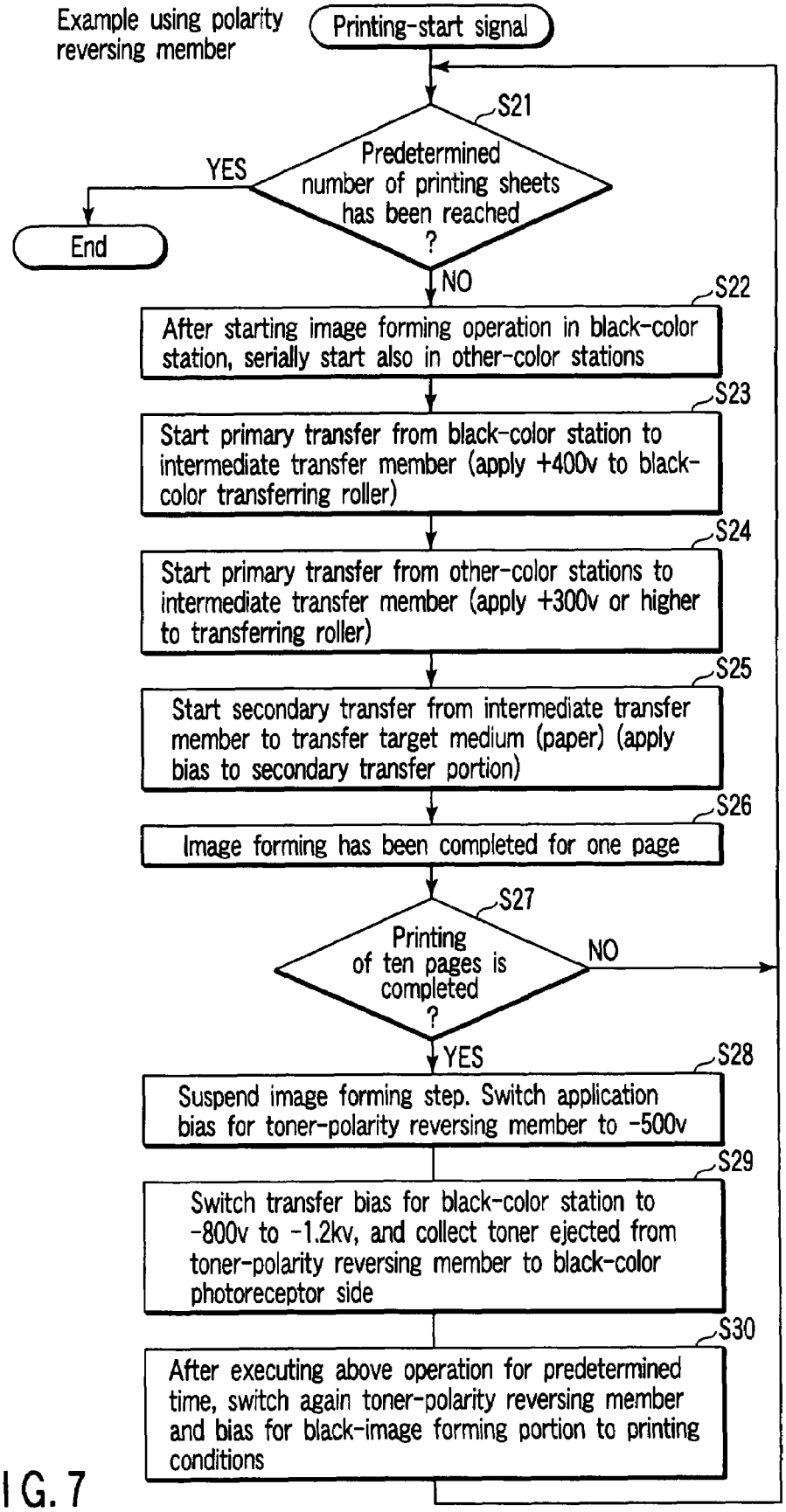
FIG. 7 is a flow diagram in the event that toner materials are returned by using a polarity reversing member in an image forming apparatus according to one embodiment of the present invention.

By way of example, processing is performed as shown in a flow diagram of FIG. 7. When ten continuous A4-size sheets (pages) are present (S21) for example, upon start of a continuous print operation, the image forming operation is started in the black-color station. Thereafter, image forming is serially started also in the other stations (S22). Then, a bias of +400v is applied to the black-color transferring roller to start the primary transfer from the black-color station to the intermediate transfer member 21 (S23). Subsequently, a bias of, for example, +300v or higher is applied to start primary transfer for other colors to the intermediate transfer member 21 (S24). Then, bias is applied to the secondary transfer portion to start secondary transfer from the intermediate transfer member 21 to a transfer target medium (paper) (S25). This completes image forming of one page (S26).

The image forming is iterated (S27) until printing of ten pages is completed; and upon completion of printing, toner collection is performed. Specifically, the bias for the toner retaining member 331 is switched −500v (S28). Then, the bias for the black-image forming portion is switched to a level of −800v to −1.2 kv, and toner ejected from the toner-polarity reversing member (portion) is collected into the black-image photoreceptor side (S29). In this case, it is important that the bias for the other color image forming portions Y6, M6, and C6 is not reversed to prevent color mixture. When the operation as described above is performed for a predetermined time, and the toner collection is completed thereby, biases for the toner retaining member 331 and the black-color exposure unit K4 are switched again to be set to printing conditions (S30).

Third Embodiment

A third embodiment provides an image forming apparatus that performs toner recycling by not necessarily controlling residue toner to be collected into the black-image forming portion, but by controlling residue toner to be collected into an other-color image forming portion.

Figure 5:
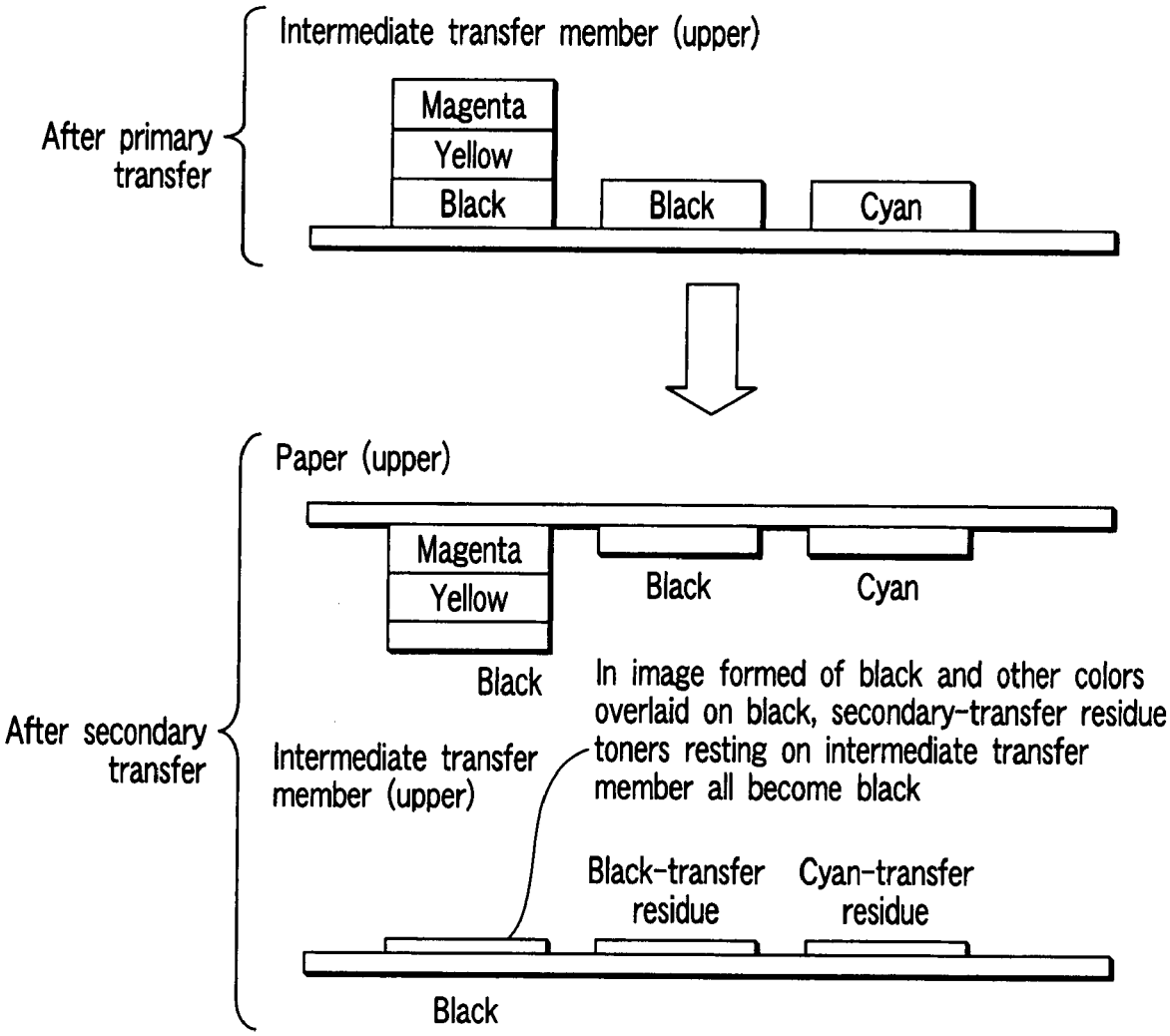
FIG. 5 is a view descriptive of residue inks on an intermediate transfer member of an image forming apparatus according to one embodiment of the present invention.

Specifically, as shown in FIG. 5, yellow, black, black, cyan toners, for example, remains on the intermediate transfer member after primary transfer. However, magenta, black, and cyan are transferred on paper after secondary transfer, so that an image formed thereby on the intermediate transfer member is based on the color of a lowest layer, and primarily black remains thereon. In an image formed of black overlaid with an other color, secondary-transfer residue toner staying on the intermediate transfer member totally becomes black.

Figure 8:
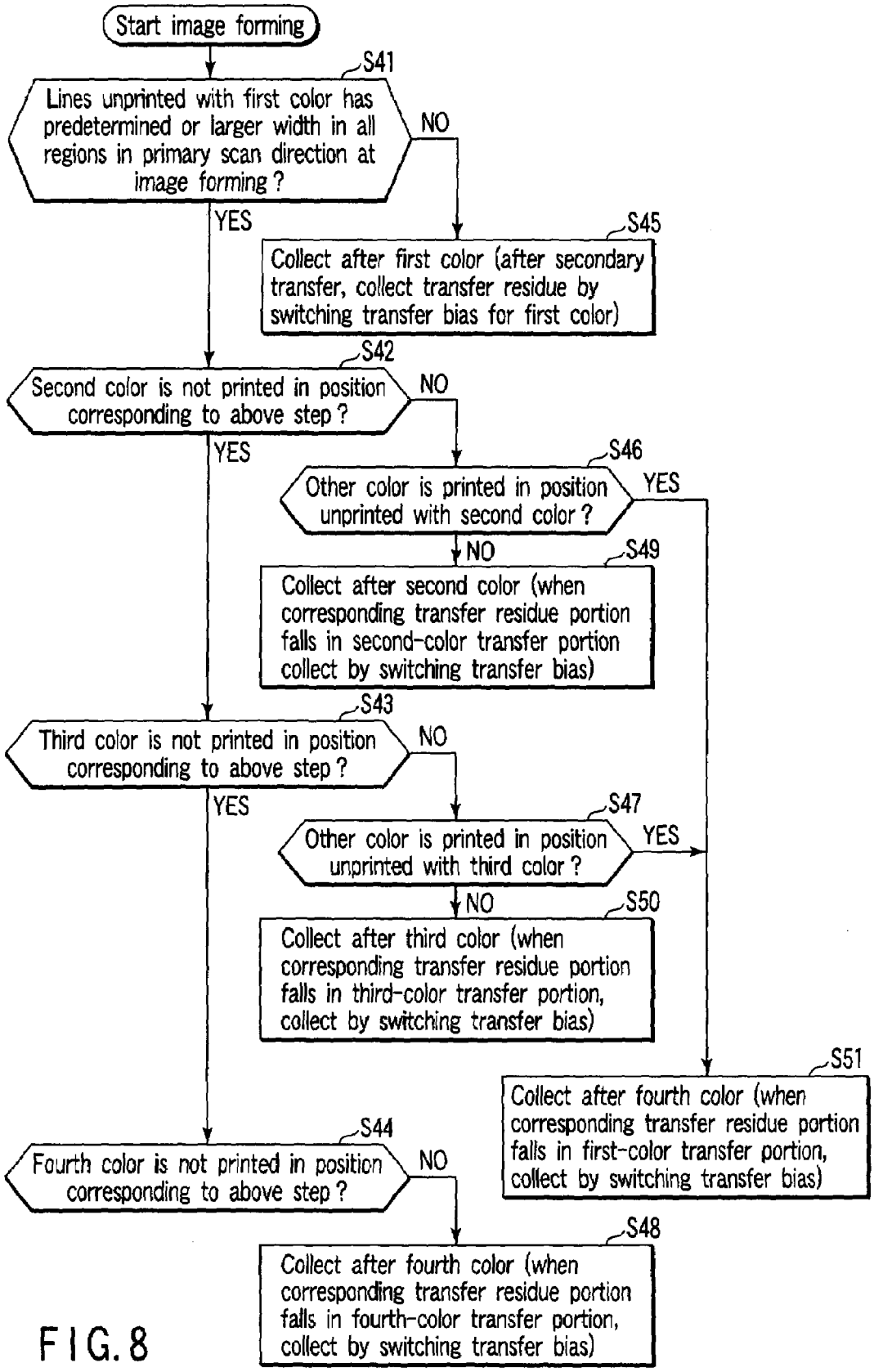
FIG. 8 is a flow diagram in the event that toner materials are returned to an optimal station in an image forming apparatus according to one embodiment of the present invention.

As shown in a flow diagram of FIG. 8, the third embodiment does not collect residue toner necessarily into the black-image forming portion, but collects the toner in an other-color image forming portion. Specifically, in step S41 the processing determines whether lines unprinted with a first color (black, for example) is not printed have a predetermined or larger width in an overall region in the primary scan direction in the event of image forming operation (S41). If the lines unprinted with the first color have the predetermined or larger width (in the event of "NO" (simply shown as "NO", hereafter)), the processing proceeds to step S45. Then, after secondary transfer, the transfer bias for the first color is switched, and residue toner is collected (S45) in a first-color image forming portion (image forming portion for the first color). If in step S41 the lines unprinted with the first color have the predetermined or larger width (in the event of "YES" (simply shown as "YES", hereafter)), the processing proceeds to step S42. If in step S42 a second color (magenta, for example) is printed in a corresponding position ("NO"), the processing proceeds to step S46 and determines whether an other color is printed in a position unprinted with the second color. If in step S46 an other color is not printed in the position unprinted with the second color ("NO"), the processing proceeds to step S49. When a corresponding transfer residue portion falls in a second-color transfer position, the transfer bias is switched and residue toner is collected in the second-color image forming portion (S49). On the other hand, if in step S46 an other color is printed in the position ("YES"), the processing proceeds to step S51. Then, when the corresponding transfer residue portion falls in a first-color transfer position, the transfer bias is switched and toner collection is performed to collect residue toner in a first-color image forming portion (S51).

If in step S42 the second color is not printed on the line unprinted with the first color ("YES"), the processing proceeds to step S43 and determines therein whether a third color (cyan, for example) is not printed in a position corresponding to the above-described step. If in step S43 the third color is printed therein ("NO"), the processing proceeds to step S47, and the processing determines whether an other color is printed in a position unprinted with the third color (S47). If in step S47 an other color is not printed therein ("NO"), the processing proceeds to step S50. When a corresponding transfer residue portion falls in a third-color transfer position, the transfer bias is switched and toner collection is performed to collect residue toner in a third-color image forming portion (S50). On the other hand, if in step S47 an other color is printed in the position ("YES"), the processing proceeds to step S51. Then, when the corresponding transfer residue portion falls in a first-color transfer position, the transfer bias is switched and toner collection is performed to collect residue toner in the first-color image forming portion (S51).

If in step S43 the third color (such as cyan) is not printed in the position corresponding to the above-described step ("YES"), the processing proceeds to step S44, and the processing determines whether only a fourth color is printed (S44). If in step S44 only the fourth color is printed therein, the processing proceeds to step S48. When a corresponding transfer residue portion falls in a fourth-color transfer position, the transfer bias is switched and toner collection is performed to collect residue toner in a fourth-color image forming portion (S48).

As described above, in the event that the color of the lowest layer when a color is overlaid on the intermediate transfer member 21 is identical in the primary scan direction, the toner is collected in a station corresponding to that color. When multiple colors are mixed, however, the toner is collected in the black station. This makes it possible to implement effective toner collection.

Fourth Embodiment

A fourth embodiment provides an image forming apparatus that performs toner recycling in the manner that, concurrently with residue toner collection by transfer-bias switching, a toner-collection dedicated belt cleaner 225 is provided, and toner is collected by a dedicated collection pathway 224 such as an auger into the black-color developing unit.

Specifically, while the above has described the methods for collecting the secondary-transfer residue toner, jam toner, and the like, it is difficult for these methods to completely prevent color mixture in the collection operation. Although color mixture does not occur only in the method with the cleaner provided to the color photoreceptor, while the amount is small, toner waste is unexpectedly is produced.

Figure 9:
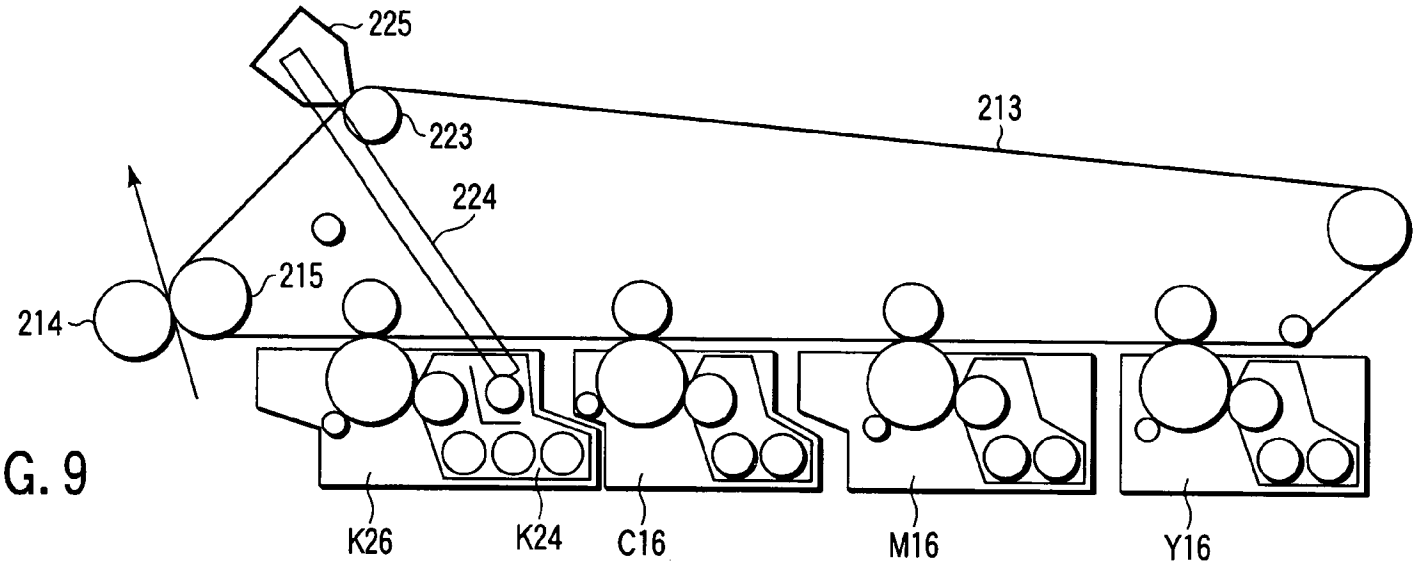
FIG. 9 is a cross-sectional view showing another example of an image forming unit of an image forming apparatus according to one embodiment of the present invention.

As such, in the present invention, as shown in FIG. 9, secondary-transfer residue toner, jam toner, or the like is temporarily collected by a belt cleaner 225, and the toner is returned to a black-color developing unit K24 by using a mechanical collection pathway such as an auger 224, and air pump. As an example, a toner recycling mechanism using the auger 224, which can be seen in a monochromatic-image dedicated copier, is utilized as it is. Thereby, unnecessary toner such as secondary-transfer residue toner resting on the belt is returned to the black-color developing unit K24. By concurrently using such a collection mechanism, color mixture into color developing units can be completely prevented in the event of unnecessary toner resting on the belt. In this case, the developing unit configuration may be made such that, for example, the developing unit K24 of a black-color image forming portion K26 is formed greater than other-color developing units, and a developer is automatically gradually ejected from the developing units. Thereby, essential service life of the black-color developing unit into which toner waste is entrained is prolonged.

More specifically, in any one of the embodiments described above, the primary functionality is to return toners such as transfer residue toner or jam toner, which is formed of inseparable mixed colors, to the black-color developing unit. In the case of the black-color developing unit, while color mixture influence surely is less in comparison to other colors, all unnecessary foreign matters including paper dust and other dust, for example are returned to the black-color developing unit. This makes it difficult to maintain the same service life of the black-color developing unit as those of the other-color developing units. As such, by way of the apparatus configuration, the capacity of the black-color developing unit is preliminarily set greater than others, and the developer is correspondingly set greater. Consequently, the service life of the black-color developing unit becomes the same as those of other-color developing units, whereby maintenance is facilitated. As a preferable example, the developer storage capacity of the other color developing units is 200 g, only the developer storage capacity for the black-color developing unit is set to 400 g.

That is, as shown in FIG. 9, it is preferable that, for example, the capacity of the black-color developing unit K24 be set greater than those of the other-color developing units, and forced developer ejection amount of the black-color developing unit be increased. In addition, in the two-component developing method, unnecessary foreign matters are entrained into the black-color developing unit, carrier deterioration therein advances earlier than in the other-color developing units. For this reason, a developer ejection port is preferably provided to the black-color developing unit thereby to allow developer ejection to be performed progressively along with printing.

Figure 10B:
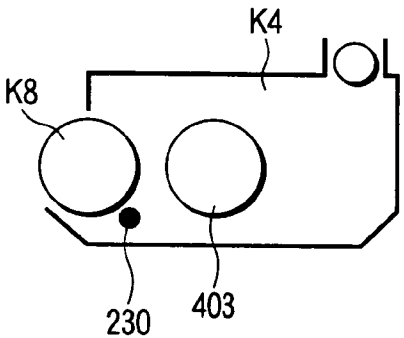
FIG. 10B is a cross-sectional view showing an example of a black-color developing unit of an image forming unit of an image forming apparatus according to one embodiment of the present invention.
Figure 10A:
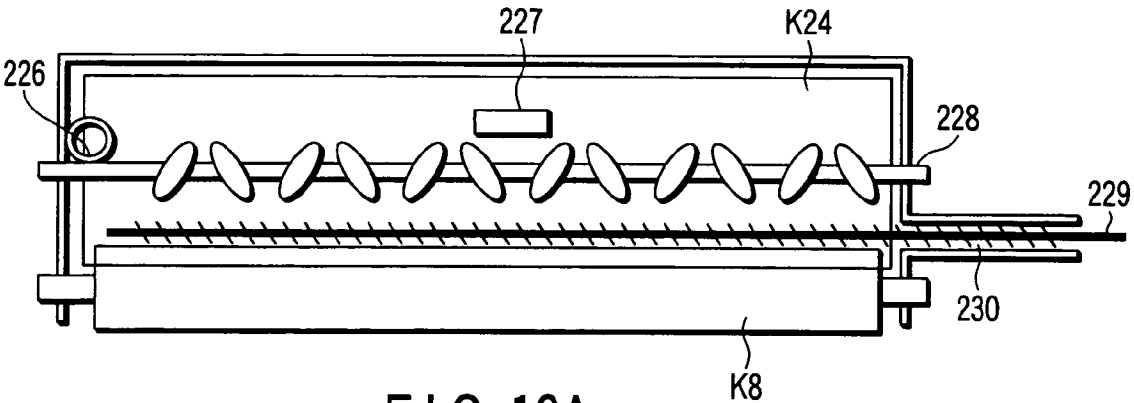
FIG. 10A is a cross-sectional view showing an example of a black-color developing unit of an image forming unit of an image forming apparatus according to one embodiment of the present invention.

An example configuration in which a developer ejection port provided is shown in FIGS. 10A and 10B. In these drawing figures, a black-color developing unit K24 has a reception port 226, a toner-concentration detector portion 227, an agitating roller 228, a developer ejection rod 229, and a developer ejection port 230.

Further, for the black-color developing unit K24, a substance formed by mixing slight carrier with toner may be stored in a toner cartridge so as to be automatically supplied. Alternatively, a carrier cartridge may be provided separately from a toner cartridge for the toner to be progressively supplied along with ejection thereof. In the two-component development, since the service life of carrier is limited from the beginning, the replacement thereof is indispensable. As such, the configuration may be such that, for example, developer waste returns to the toner cartridge. The configuration enables a user to progressively replace the developer in a manner almost transparent to the user. In addition, although deterioration of the black-color developer advances earlier than other-color developer, the developer need not be replaced at a specific short interval.

MODIFIED EXAMPLE

Figure 11:
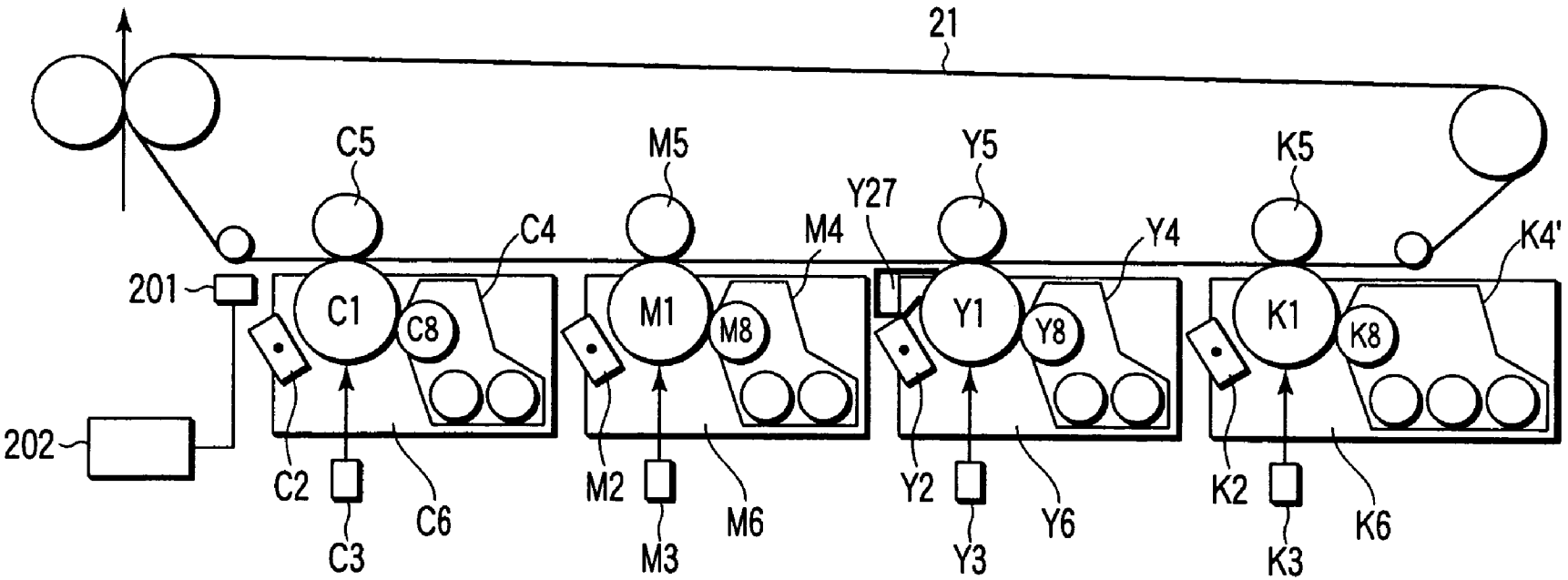
FIG. 11 is a cross-sectional view showing another example of an image forming unit of an image forming apparatus according to one embodiment of the present invention.

Another modified example is shown in FIG. 11. As shown therein, in a configuration where first to fourth image forming portions are provided on an intermediate transfer member along an intermediate transfer member 203, it is preferable that a developing unit K4' larger than other developing units of the image forming portions be provided in the image forming portion provided highest upstream in the movement direction. Thereby, similar to the case of the above-described embodiment, the collection of a large amount of residue toner is facilitated by the black-toner image forming portion having a large-capacity processing function.

Figure 12:
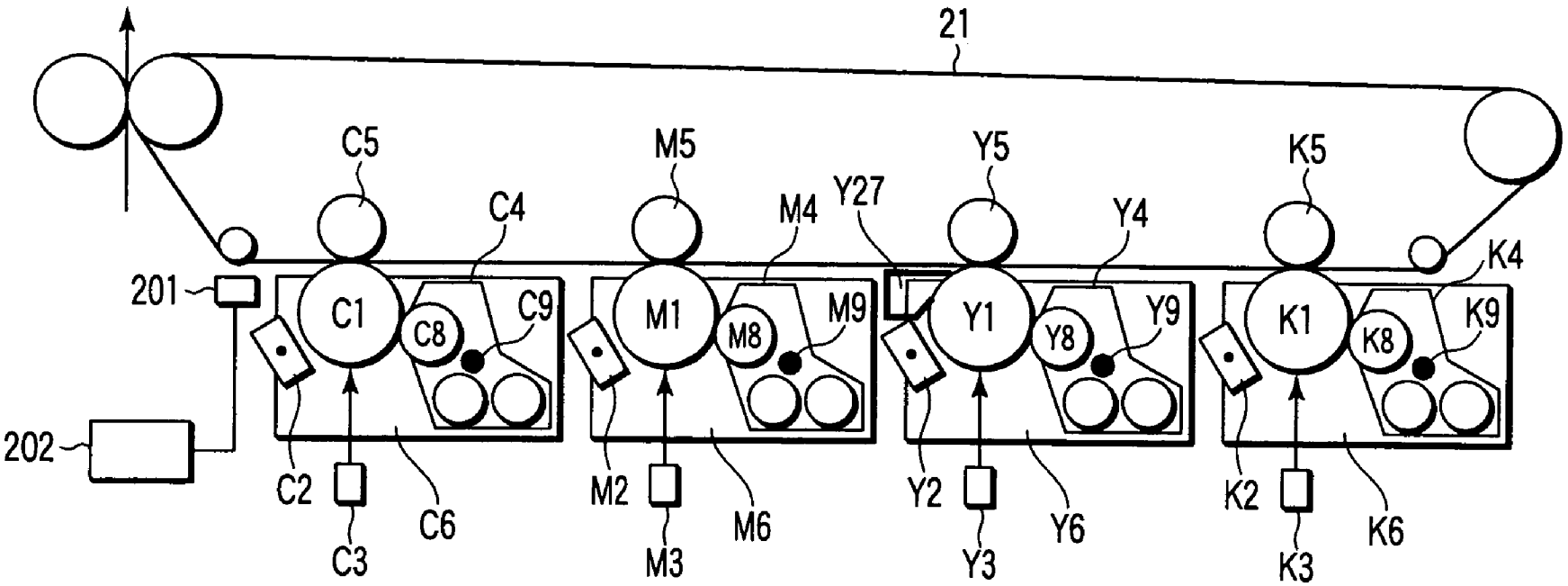
FIG. 12 is a cross-sectional view showing another example of an image forming unit of an image forming apparatus according to one embodiment of the present invention.

In addition, ejection to be performed along with printing by providing the developer ejection port to the developing unit is preferably adapted not only to the black-color developing unit, but also to the other-color developing units. With reference to FIG. 12, respective developing units K4, Y4, M4, and C4 have developer ejection ports K9, Y9, M9, and C9, thereby enabling saving labor and time costs required of a user for developer replacement. In this case, the amount of developer to be ejected in the event of printing for the black-color developing unit is increased in comparison to those for the other-color developers. Thereby, even when foreign matters such as paper dust and other dust, or substances such as mixed color toner and excessive foreign additives are entrained in the black-color developing unit, the influence thereof is reduced thereby to enable maintain the same performance in visual effect as those of the other-color developing units.

In experiments, first, in a method for collecting transfer residue toner or the like for recycling to a black-color developing unit by using an intermediate transfer member, while performing 6% printing of a regular A4 size sheet, the degrees of fogging (toner adhesion to a non-image region of paper or a photoreceptor) were measured with the following results. In a color developing, the developer ejection amounts were stabilized at about 2 g/k-piece without causing fogging. However, in the event that the capacity is set identical in the black-color developing unit, fogging occurred on about 100 k-pieces after printing, at about the same 2 g/k-piece. For example, when the developer ejection amount is set to 2.5 g/k-piece, while no fogging occurred even after printing of 100 k-pieces, the result was "NG" (no good). When the developer storage capacity of only the black-color developing unit was set greater than others (400 g for the black-color developing unit relative to 400 g for the color developing unit), the result was good even after printing of 200 k-pieces even with the developer ejection amount of 2 g/k-piece. However, fogging occurred after printing of 300 k-pieces. As such, the amount of developer was set 400 g and the ejection amount thereof was set to 2.5 g/k-piece. As a result, no fogging occurred even after printing of 300 k-pieces.

Printing results in the experiments described above are shown in FIG. 13. As described above, when also the secondary-transfer residue toner is returned to the black-color exposure unit K4, developer deterioration in the black-color exposure unit K4 is accelerated in comparison to the other developing units. For this reason, it is preferable that the ejection amount of developer be increased and/or the developer storage capacity be increased. When automatic developer ejection was not performed, 50 k-pieces were "NG" in the black-color developing unit. When only the black-color developing unit was increased in capacity, the service life was of course prolonged, and the result was "NG" at the same 200 k-pieces as in the case of the color developing unit.

These tendencies are similar to the method wherein, as shown in FIGS. 1, 3, and 4, the toner recycling mechanism is not used, but the biases were utilized to finally collect secondary-transfer residue toner in the black-color developing unit. However, part of dust such as paper dust having charge opposite that of toner is slightly entrained into the color developing units. As such, in a configuration as shown in, for example, FIG. 9, deterioration of the yellow-color developer tends to be faster in comparison to the case of the other-color developing units on the first stage. This is caused for the reason that since the yellow color is present on the first stage, paper dust, dust, and the like, which is in the above-described opposite-charged state or is substantially not charged, tends to adhere thereto. In this case, preferably, while the black-color developing unit is separately handled, the automatic developer ejection amount is set larger or developer storage capacity is set larger for the developing unit on the first stage in comparison to the other-color developing units.

In the configuration of FIG. 3 or FIG. 4, for example, the yellow-color developer caused fogging at an ejection amount of 2 g/k-piece after printing of 300 k-pieces. When the ejection amount was set to 2.5 g/k-piece, however, no fogging occurred even after printing of 300 k-pieces. Needless to say, no fogging occurred at the ejection amount of 400 g, after printing of 300 k-pieces, either.

In a direct transfer configuration, which is not employing the intermediate transfer method, since secondary-transfer residue toner is not basically generated, deterioration of the black-color developer tends to be somewhat alleviated. Nevertheless, however, since inseparable toner is finally returned to the black-color developing unit, deterioration of the black-color developing unit advances faster than in a regular case. Further, in this method, a larger amount of paper dust and the like is entrained in the developing unit of the highest-upstream image forming portion. As such, preferably, the black-color developing unit and the developing unit on the highest upstream side are enlarged, automatic developer ejection is performed, and/or the automatic ejection amount is et larger in comparison to those for the other image forming portions.

FIG. 13 shows exemplary running test results. It can be known from the results that developer deterioration in the highest-upstream developing unit is faster than in the cases of the other-color developers. As such, for example, the capacities of the highest-upstream developing unit and the black-color developing unit are enlarged, automatic developer ejection and supply are performed, and the automatic developer ejection amount is set larger then those for the other colors. Thereby, for example, the apparent service lives of the developing units in all the imaging forming sections become substantially the same, and apparatus usability for users is enhanced. In addition, the apparent service life can be prolonged also by setting the above-described factors to be even larger only for the black-color developing unit.

What is claimed is:

1. A color image forming apparatus comprising:

a first image forming portion having a first charger unit which charges a first image bearing member, a first exposure unit which forms a first electrostatic latent image on the first image bearing member, and a first developing unit which houses first toner and forms the first toner image corresponding to the first electrostatic latent image on the first image bearing member while collecting residual toner remaining on the first image bearing member;

a second image forming portion having a second charger unit which charges a second image bearing member, a second exposure unit which forms a second electrostatic latent image on the second image bearing member, and a second developing unit which houses second toner and forms the second toner image corresponding to the second electrostatic latent image on the second image bearing member while collecting residual toner remaining on the second image bearing member;

a third image forming portion having a third charger unit which charges a third image bearing member, a third exposure unit which forms a third electrostatic latent image on the third image bearing member, and a third developing unit which houses third toner and forms the third toner image corresponding to the third electrostatic latent image on the third image bearing member while collecting residual toner remaining on the third image bearing member;

a fourth image forming portion having a fourth charger unit which charges a fourth image bearing member, a fourth exposure unit which forms a fourth electrostatic latent image on the fourth image bearing member, and a fourth developing unit which houses fourth toner and forms the fourth toner image corresponding to the fourth electrostatic latent image on the fourth image bearing member while collecting residual toner remaining on the fourth image bearing member;

an intermediate transfer member which carries the first, second, third, and fourth color toner images thereon;

a first transfer member which transfers the first, second, third, and fourth color toner images in order on the intermediate transfer member, the first transfer member comprising individual transfer members which respectively transfer the first, second, third, and fourth color toner images in order on the intermediate transfer member;

a second transfer member which transfers the first, second, third, and fourth color toner images on the intermediate transfer member onto the image recording medium; and a control portion which, when transfer of the toner image from the intermediate transfer member to the image recording medium is completed, controls to return the residual toner remaining on the intermediate transfer member to the first image bearing member, wherein the first image forming portion is set at most upstream along the moving direction of the intermediate transfer member and the second, third, and fourth image forming portions are downstream of the first image forming portion along the moving direction of the intermediate transfer member, the first image forming portion houses the black toner as the first toner in a predetermined quantity which is larger than the quantity of the second toner in the second developing unit, the third toner in the third developing unit, and the fourth toner in the fourth developing unit, and the first developing unit ejects at least a part of the black toner in the first developing unit as waste toner.

2. The color image forming apparatus according to claim 1, wherein a size of the first developing unit is larger than a size of each of the second, third and fourth developing units.

3. The color image forming apparatus according to claim 1, wherein a toner ejection member of the first developing unit has a rod for ejecting a content.

4. The color image forming apparatus according to claim 1, wherein a bias of at least one of the first, second, third and fourth charger units, and the first and second transfer members is displaced to return the residual toner to one of the first, second, third and fourth developing units.

5. The color image forming apparatus according to claim 1, wherein at least one of the second image forming unit, the third image forming unit, and the fourth image forming unit has a cleaner portion for the image bearing member.

6. A color image forming apparatus according to claim 1, further comprising:

a collection portion which is provided in a midway of a conveyance path of the intermediate transfer member and which collects a residue of toner material for forming the toner images;

a dedicated pathway which dedicatedly moves the residue of the toner material in the collection portion to the first developing unit of the first forming portion.

7. A color image forming apparatus according to claim 1, wherein only the first developing unit of the first forming portion has an ejection port.

8. A color image forming apparatus according to claim 1, wherein the first developing unit of the first forming portion, the second developing unit of the second forming portion, the third developing unit of the third forming portion, and the fourth developing unit of the fourth forming portion individually have ejection ports, the ejection port of the first developing unit of the first forming portion provides a higher ejection velocity than the individual ejection ports of the second to fourth developing units.

9. A color image forming apparatus according to claim 1, wherein the color image forming apparatus is applied to a color digital copier and a printer device.

10. A color image forming apparatus comprising:

a first image forming portion having a first charger unit which charges a first image bearing member, a first exposure unit which forms a first electrostatic latent image on the first image bearing member, and a first developing unit which houses first toner and forms the first toner image corresponding to the first electrostatic latent image on the first image bearing member while collecting residual toner remaining on the first image bearing member;

a second image forming portion having a second charger unit which charges a second image bearing member, a second exposure unit which forms a second electrostatic latent image on the second image bearing member, and a second developing unit which houses second toner and forms the second toner image corresponding to the second electrostatic latent image on the second image bearing member while collecting residual toner remaining on the second image bearing member;

a third image forming portion having a third charger unit which charges a third image bearing member, a third exposure unit which forms a third electrostatic latent image on the third image bearing member, and a third developing unit which houses third toner and forms the third toner image corresponding to the third electrostatic latent image on the third image bearing member while collecting residual toner remaining on the third image bearing member;

a fourth image forming portion having a fourth charger unit which charges a fourth image bearing member, a fourth exposure unit which forms a fourth electrostatic latent image on the fourth image bearing member, and a fourth developing unit which houses fourth toner and forms the fourth toner image corresponding to the fourth electrostatic latent image on the fourth image bearing member while collecting residual toner remaining on the fourth image bearing member;

a transfer member which transfers the first, the second, the third, and the fourth color toner images in order onto an image recording medium; and a control portion which, when transfer of the toner image from the transfer member to the image recording medium is completed, controls to return the toner on the transfer member to the first image bearing member, wherein a first image forming portion is set at most upstream along the moving direction of the transfer member and the second, third, and forth image forming portions are downstream of the first image forming portion along the moving direction of the transfer member;

the first image portion houses the black toner as the first toner in predetermined quantity which is larger than the quantity of the second toner in the second developing unit, the third toner in the third developing unit, and the fourth toner in the fourth developing unit; and the first developing unit ejects at least a part of the black toner in the first developing unit as waste toner.

11. The color image forming apparatus according to claim 10, wherein a size of the first developing unit is larger than a size of each of the second, third and fourth developing units.

12. The color image forming apparatus according to claim 10, wherein a toner ejection member of the first developing unit has a rod for ejecting a content.

13. The color image forming apparatus according to claim 10, wherein a bias of at least one of the first, second, third and fourth charger units, and the transfer member is displaced to return the residual toner to one of the first, second, third and fourth developing units.

14. The color image forming apparatus according to claim 10, wherein at least one of the second image forming unit, the third image forming unit, and the fourth image forming unit has a cleaner portion for the image bearing member.

15. A color image forming apparatus according to claim 10, further comprising:

a collection portion which is provided in a midway of a conveyance path of the transfer member and which collects a residue of toner material for forming the toner images;

a dedicated pathway which dedicatedly moves the residue of the toner material in the collection portion to the first developing unit of the first forming portion.

16. A color image forming apparatus according to claim 10, wherein only the first developing unit of the first forming portion has an ejection port.

17. A color image forming apparatus according to claim 10, wherein the first developing unit of the first forming portion, the second developing unit of the second forming portion, the third developing unit of the third forming portion, and the fourth developing unit of the fourth forming portion individually have ejection ports, the ejection port of the first developing unit of the first forming portion provides a higher ejection velocity than the individual ejection ports of the second to fourth developing units.

18. A color image forming apparatus according to claim 10, wherein the color image forming apparatus is applied to a color digital copier and a printer device.

* * * * *